US005394215A

United States Patent [19]

Glover

[11] Patent Number: 5,394,215

[45] Date of Patent: Feb. 28, 1995

[54] PHOTOGRAPHIC PROCESSING APPARATUS

[75] Inventor: Edward C. Glover, London, England

[73] Assignee: Eastman Kodak Company, Rochester, N.Y.

[21] Appl. No.: 167,886

[22] PCT Filed: Jun. 12, 1992

[86] PCT No.: PCT/EP92/01316

§ 371 Date: Dec. 16, 1993

§ 102(e) Date: Dec. 16, 1993

[87] PCT Pub. No.: WO92/22853

PCT Pub. Date: Dec. 23, 1992

[30] Foreign Application Priority Data

Jun. 18, 1991 [GB] United Kingdom ..... 9113120

[51] Int. Cl.[6] ..... G03D 3/08

[52] U.S. Cl. ..... 354/319; 354/329; 354/331; 354/339

[58] Field of Search ..... 354/319–322, 354/329, 330, 323, 339, 331; 134/64 R, 64 P, 122 P, 122 R

[56] References Cited

U.S. PATENT DOCUMENTS 4,225,872 9/1980 Marinoff ..... 346/75
4,390,176 6/1983 Kato ..... 271/270
4,798,375 1/1989 Yamamoto ..... 271/82
4,838,537 6/1989 Matsuda et al. ..... 271/277

FOREIGN PATENT DOCUMENTS 2010736 3/1970 Germany .
545901 11/1940 United Kingdom .

*Primary Examiner*—D. Rutledge
*Attorney, Agent, or Firm*—Frank Pincelli

[57] ABSTRACT

In small processing machines, the rate at which material passes through the machine tends to be low due to its size. This results in the access time being long as it is the sum of the actual processing time at each stage, plus the crossover times between each stage, and finally the time it takes for the whole sheet of material being processed to emerge from the machine. Described herein is apparatus which allows the transport rate between each stage and the exiting speed of the material from the apparatus to be increased. The apparatus comprises a rotating drum around which a guide is arranged to define a processing tank. Material to be processed is transported around the surface of the drum in the processing tank by transport roller set. The roller set comprises a fixed roller to which rollers are pivotally connected. Roller is lifted from against the surface of the drum to allow the material to be switched out of the tank. Similarly, roller may be lifted to allow the material to enter the tank and lie against the surface of the drum.

12 Claims, 2 Drawing Sheets

PHOTOGRAPHIC PROCESSING APPARATUS

FIELD OF THE INVENTION

This invention relates to photographic processing apparatus and is more particularly concerned with such apparatus used to process sheet material.

BACKGROUND OF THE INVENTION

It has been known for over 20 years to use high speed drum arrangements for processing photographic material. In such arrangements, the material to be processed is held stationary by a blanket whilst the drum rotates beneath it.

In other arrangements, the material being processed is usually clamped or clipped to the drum so that it rotates therewith and there is no relative motion between the material and the drum.

U.S. Pat. No. 4,838,537 discloses an arrangement for automatic winding and discharging of a sheet of material, the sheet of material being wound on to a drum prior to its discharge.

U.S. Pat. No. 4,225,872 discloses an ink jet printer in which a rotary support is used to support the material being printed. The material is clipped to the rotary support for its rotation relative to the ink jet printing head.

SUMMARY OF THE INVENTION

In small processing machines, the rate at which material passes through the machine is low due to its size. This results in the access time being long because it is the sum of the actual processing time at each stage, plus the crossover times between each stage, and finally the time it takes for the whole sheet of material being processed to emerge from the machine.

It is therefore an object of the present invention to provide apparatus which increases the transport rate between each stage and the exiting speed of the material from the apparatus.

According to one aspect of the present invention, there is provided photographic processing apparatus for processing photographic material, the apparatus comprising:

a rotating drum, a guide surrounding the drum and defining a processing tank therebetween, and transport means for transporting the photographic material around the drum;

characterized in that the transport means includes a first movable roller which is movable from a first position adjacent the surface of the drum where the material is constrained and transported around the drum, and a second position away from the surface of the drum where the material is free to leave the surface of the drum.

Advantageously, the transport means further includes a second movable roller which is movable from a first position adjacent the surface of the drum where the material is constrained and transported around the drum, and a second position away from the surface of the drum where the material is free to enter the apparatus and pass over the surface of the drum.

By this arrangement, the relative motion between the drum and the material being processed provides agitation of the material surface which assists the processing.

For a better understanding of the present invention, reference will now be made, by way of example only, to the accompanying drawings in which:

DESCRIPTION OF THE PREFERRED EMBODIMENT

Figure 1:
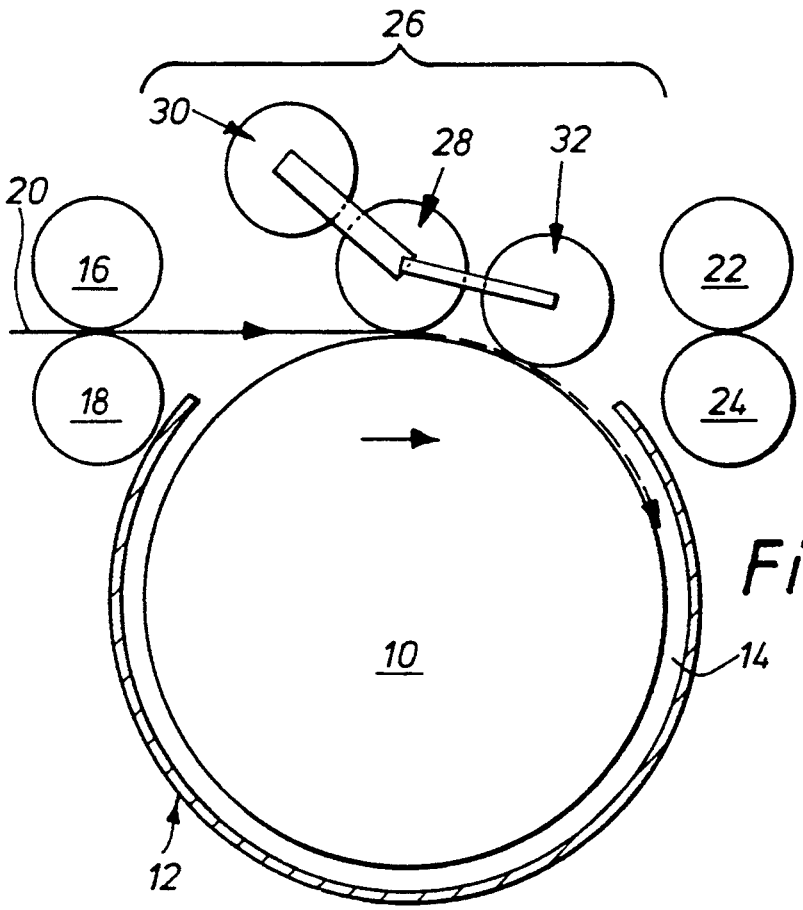
FIG. 1 is a schematic side view of apparatus constructed in accordance with the present invention and which illustrates paper entering the apparatus.

The apparatus shown in the Figures comprises a drum 10 which is surrounded by a guide 12. The guide 12 and the drum 10 define therebetween a processing tank 14 in which processing solution (not shown) is retained. A first pair of rollers 16, 18 are positioned to feed sheet material 20 into the processing tank 14. A second pair of rollers 22, 24 are positioned to feed sheet material out of the processing tank 14 after processing. A transport roller set 26 acts to guide the material 20 into and out of the processing tank 14. The roller set 26 comprises a roller 28 to which two other rollers 30 and 32 are pivotally connected. Roller 28 is free to rotate about its axis, and capable of slight movement in a radial direction away from and towards the surface of the drum 10.

As shown in FIG. 1, as material 20 is being fed into the tank 14, roller 30 is lifted so that the material 20 can be guided, by rollers 28 and 32 into the tank 14, and is guided around the drum 10 by the guide 12.

Figure 2:
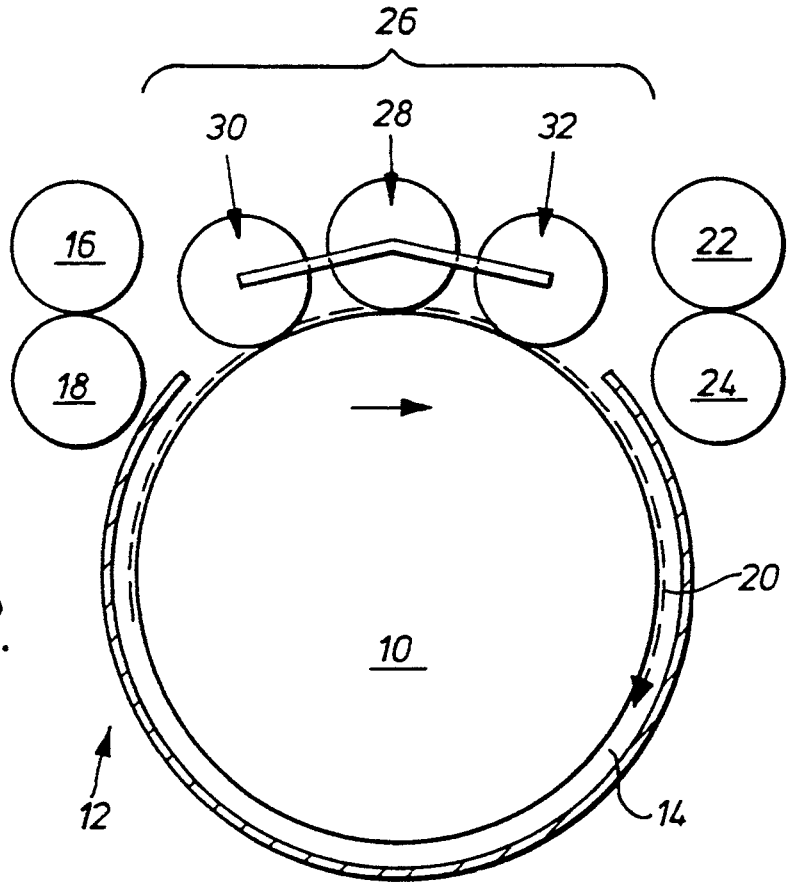
FIG. 2 is a schematic side view of apparatus shown in FIG. 1 and which illustrates paper being processed in the apparatus.

As soon as the tail end of the sheet of material 20 has passed under roller 28 of roller set 26, roller 30 is lowered into the position shown in FIG. 2. In this position, the roller set 26 both constrains the material 20 and transports it around the drum 10 until it has completed its processing and it is to be transferred on to the next processing stage.

Figure 3:
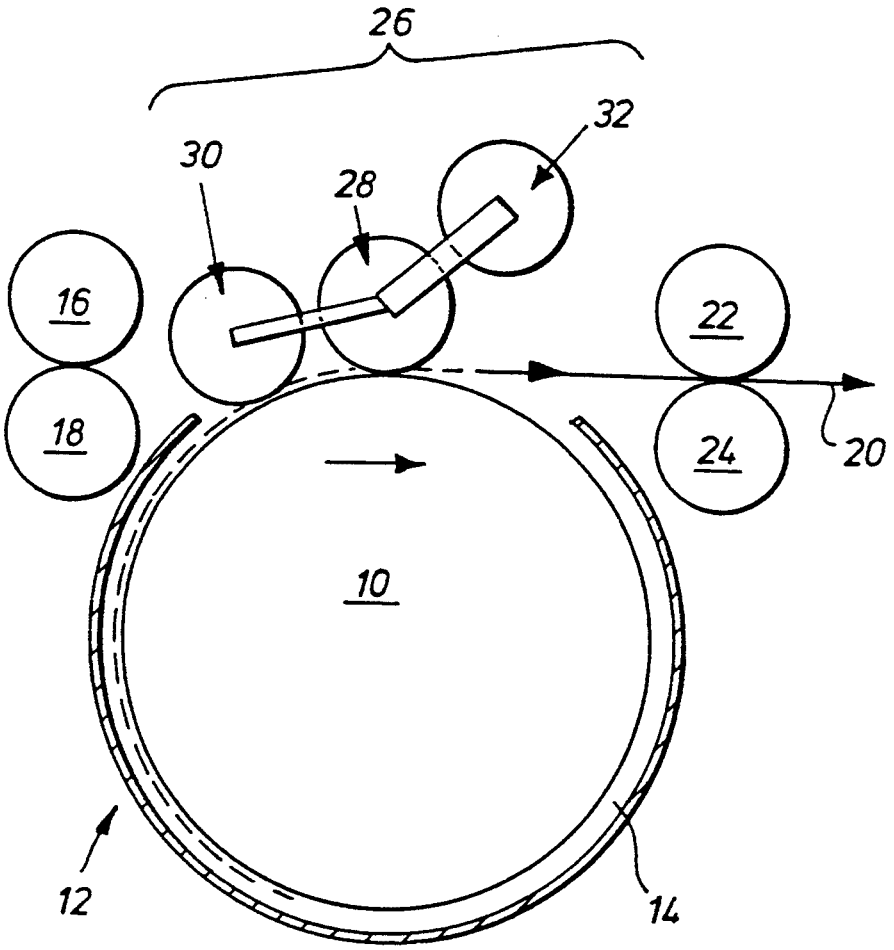
FIG. 3 is a schematic side view of apparatus shown in FIG. 1 and which illustrates paper leaving the apparatus.

At this stage, after processing has been completed, the material 20 is switched out of the tank 14. This is achieved by raising roller 32 in roller set 26 so that the material 20 is directed into the nip formed in the second pair of rollers 22, 24 to be removed from the tank 14. This arrangement is shown in FIG. 3.

After the tail end of the sheet of material 20 has left the drum 10, roller 32 is lowered and roller 30 is then raised (as discussed previously) ready for the next sheet of material to be processed.

Although the roller set 26 is shown as only having three rollers 28, 30, 32, it may have more rollers depending on the particular arrangement.

In one embodiment of the present invention, a small drum could be used around which the material to be processed is propelled. The drum has a diameter which is chosed so that when the contraining forces of the roller set 26 is removed, the material takes a path which leads it off the surface of the drum and into the second pair of rollers 22, 24, for example squeegee rollers. It may be the case that the material being processed leaves the drum once every cycle unless it is constrained by the roller set 26.

The arrangement described may be used for either photographic film or paper.

The material may be oriented so that the sensitive surface, for example, the emulsion surface, faces the drum 10. This would offer either extremely high agitation of the surface being processed. Alternatively, the material may be processed with its sensitive surface emulsion side out with minimum agitation. This of course depend on what is required for that particular material.

Advantageously, large size sheets of material may be processed with a minimum use of processing solution. Furthermore, the access time, that is, the time to obtain a completed print from the apparatus, approaches the process cycle time for that print as it can be rapidly removed from the processor by the 'switching mechanism' of the roller 32.

In another embodiment of the present invention, it may be desirable to process roll film using this apparatus. In such a case, the film is wrapped around the drum several times.

As an alternative to the rollers 30, 32 being pivotally connected to roller 28, each roller may be independently movable with respect to the drum 10 to allow material to enter and leave the apparatus.

As an alternative to a plurality of rollers as described above, the material may be transported around the drum using a flexible drive belt which is mounted on a pair of rollers. Switching of the material out of the apparatus in this instance would be achieved by lifting one roller, and hence the belt, away from the surface of the drum to allow the material to exit from the apparatus.

I claim:

1. Photographic processing apparatus for processing photographic material, the apparatus comprising:

a rotating drum, a guide surrounding the drum and defining a processing tank therebetween, and transport means for transporting the photographic material around the drum;

characterized in that the transport means includes a first movable roller which is movable from a first position adjacent the surface of the drum where the material is constrained and transported around the drum, and a second position away from the surface of the drum where the material is free to leave the surface of the drum.

2. Apparatus according to claim 1, wherein the transport means further includes a second movable roller which is movable from a first position adjacent the surface of the drum where the material is constrained and transported around the drum, and a second position away from the surface of the drum where the material is free to enter the apparatus and pass over the surface of the drum.

3. Apparatus according to claim 2, wherein the transport means comprises a plurality of rollers of which the first and second movable rollers form a part.

4. Apparatus according to claim 3, wherein the first and second movable rollers are pivotally connected to a third roller and are relatively movable with respect thereto between the first and second positions.

5. Apparatus according to claim 2, further including inlet guide rollers for directing the material on to the surface of the drum when the second movable roller is in the second position.

6. Apparatus according to claim 3, further including inlet guide rollers for directing the material on the surface of the drum when the second movable roller is in the second position.

7. Apparatus according to claim 4, further including inlet guide rollers for directing the material on to the surface of the drum when the second movable roller is in the second position.

8. Apparatus according to claim 1, further including outlet guide rollers for directing the material out of the apparatus when the first roller is in the second position.

9. Apparatus according to claim 2, further including outlet guide rollers for directing the material out of the apparatus when the first roller is in the second postion.

10. Apparatus according to claim 3, further including outlet guide rollers for directing the material out of the apparatus when the first roller is in the second position.

11. Apparatus according to claim 4, further including outlet guide rollers for directing the material out of the apparatus when the first roller is in the second position.

12. Apparatus according to claim 5, further including outlet guide rollers for directing the material out of the apparatus when the first roller is in the second position.

* * * * *